US006350221B1

(12) United States Patent
Krull

(10) Patent No.: US 6,350,221 B1
(45) Date of Patent: Feb. 26, 2002

(54) CONVERTIBLE EXERCISE APPARATUS WITH BODY SUPPORTING ELEMENT

(76) Inventor: Mark A. Krull, 1705 E. Ridge Ct., Northfield, MN (US) 55057

( * ) Notice: Subject to any disclaimer, the term of this patent is extended or adjusted under 35 U.S.C. 154(b) by 0 days.

(21) Appl. No.: 09/374,147

(22) Filed: Aug. 13, 1999

(51) Int. Cl.[7] ..... A63B 21/072
(52) U.S. Cl. ..... 482/142; 482/108
(58) Field of Search ..... 482/72, 92, 93, 482/95, 96, 98, 99, 101–104, 106–108, 133, 138, 142, 148, 904, 910, 94; 610/24

(56) References Cited

U.S. PATENT DOCUMENTS 4,369,966 A * 1/1983 Silberman et al. ..... 482/38
4,477,074 A * 10/1984 Bushnell ..... 482/108
4,624,457 A * 11/1986 Silberman ..... 482/98
4,634,127 A * 1/1987 Rockwell ..... 482/138
4,804,179 A * 2/1989 Murphy et al. ..... 482/97
4,834,396 A * 5/1989 Schnell ..... 482/97
5,217,422 A * 6/1993 Domzalski ..... 482/138
5,518,487 A * 5/1996 Hallmark ..... 482/140
5,575,742 A * 11/1996 Wu ..... 482/92
5,779,604 A * 7/1998 Towley, III et al. ..... 482/108
6,264,586 B1 * 7/2001 Webber ..... 482/104

FOREIGN PATENT DOCUMENTS

GB 2 236 685 A * 4/1991 ..... 482/104

* cited by examiner

*Primary Examiner*—Mickey Yu
*Assistant Examiner*—Victor Hwang

(57) ABSTRACT

An exercise system includes a body support which is movable between a first position which is suitable for exercise and a second position which is suitable for transportation and/or storage. On several of the depicted embodiments, the body support is a bench which is movable relative to a weight container, between a generally horizontal orientation and a generally vertical orientation.

30 Claims, 10 Drawing Sheets

300
310
319
350
322
330

381
385
300
388
317
318
310
350
311
322
330

322
300
318
381
313
386
388
315
334
380
314
310
333
311
330
316
317
332

Fig. 11
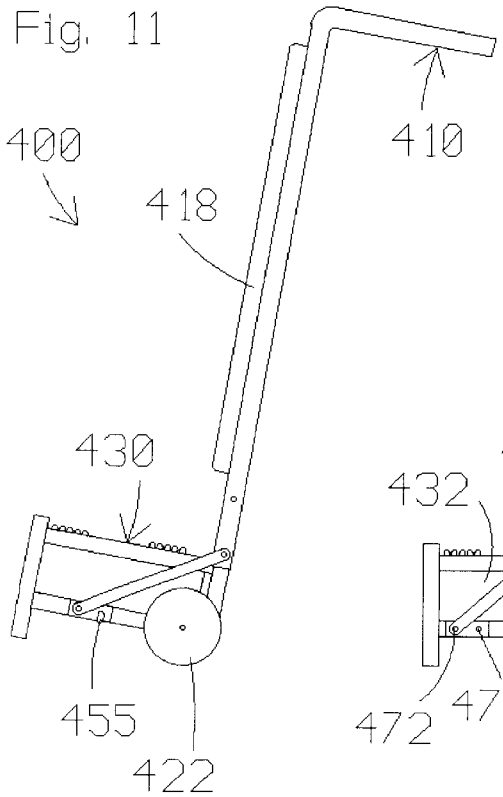
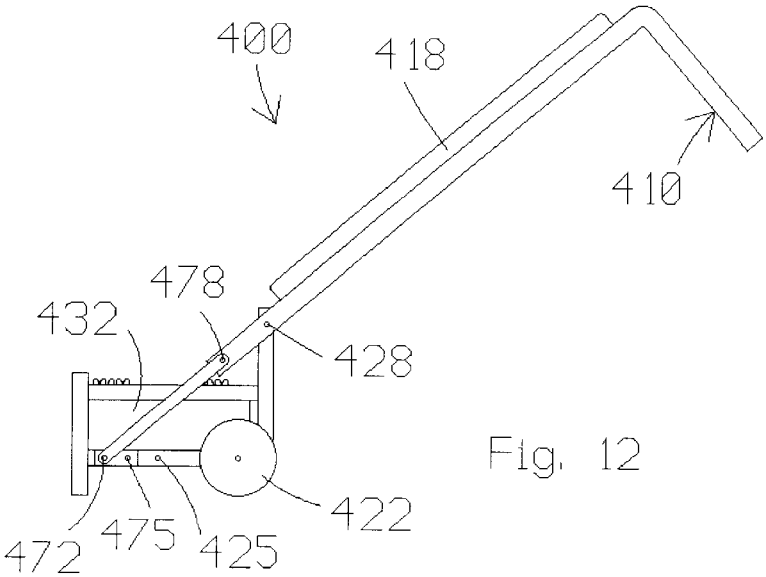
Fig. 12
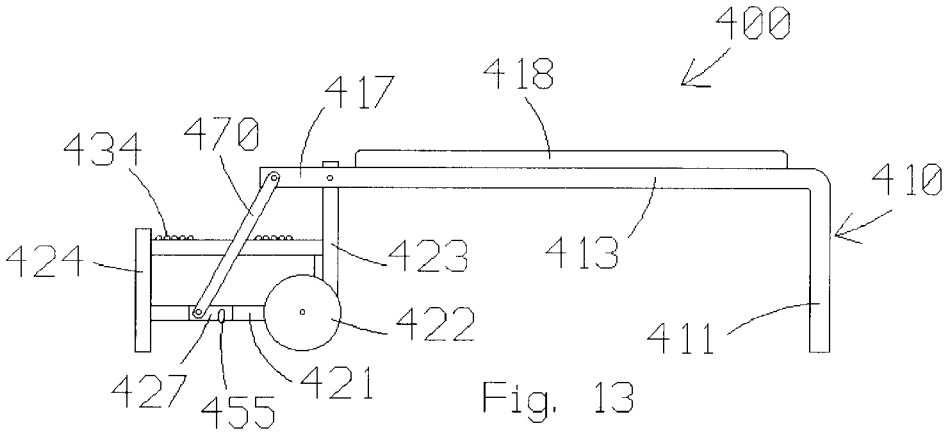
Fig. 13

CONVERTIBLE EXERCISE APPARATUS WITH BODY SUPPORTING ELEMENT

FIELD OF THE INVENTION

The subject invention relates to exercise methods and apparatus, and more specifically, to exercise equipment which provides support for at least a portion of a person's body and selectively transforms into a configuration suitable for transportation and/or storage.

BACKGROUND OF THE INVENTION

Various types of exercise equipment are known in the art. One common device is the exercise bench, which is typically designed to support a person in a supine position above a floor surface to facilitate the performance of one or more exercises involving stretching and/or strength training. Another familiar exercise device is the aerobic step, which is typically designed to provide one or more raised platforms relative to a floor surface to facilitate repeated stepping motions. Yet another popular device is the exercise dumbbell, which is typically designed with one or more weights disposed at each end of a handle.

SUMMARY OF THE INVENTION

The present invention may be described in terms of methods and apparatus for converting an exercise bench into a weight cart and/or for converting a weight cart into an exercise bench. In a first configuration, a lower end of a bench member is connected to a weight container, and an opposite, upper end of the bench member is within arm's reach for tilting and maneuvering the apparatus with the assistance of wheels on the container and/or the bench member. In a second configuration, the bench member occupies a horizontal orientation suitable for supporting a person in a supine position. Recognizing that the wheels may be locked against rotation or eliminated from the apparatus, the present invention may also be described in terms of an exercise bench that moves between operative and inoperative positions relative to a weight container. Those skilled in the art will also recognize that the present invention is applicable to other types of body supporting equipment, including an aerobic step, for example. Indeed, various features and applications will become apparent from the more detailed description that follows.

BRIEF DESCRIPTION OF THE DRAWING

With reference to the Figures of the Drawing, wherein like numerals represent like parts and assemblies throughout the several views.

FIG. 11 is a side view of a fourth exercise system constructed according to the principles of the present invention and including a weight container and an exercise bench interconnected in a transport configuration;

FIG. 12 is a side view of the system of FIG. 11 in a state of transformation;

FIG. 13 is a side view of the system of FIG. 11 with the weight container and the exercise bench interconnected in an exercise configuration;

DETAILED DESCRIPTION OF THE PREFERRED EMBODIMENT

Figure 1:
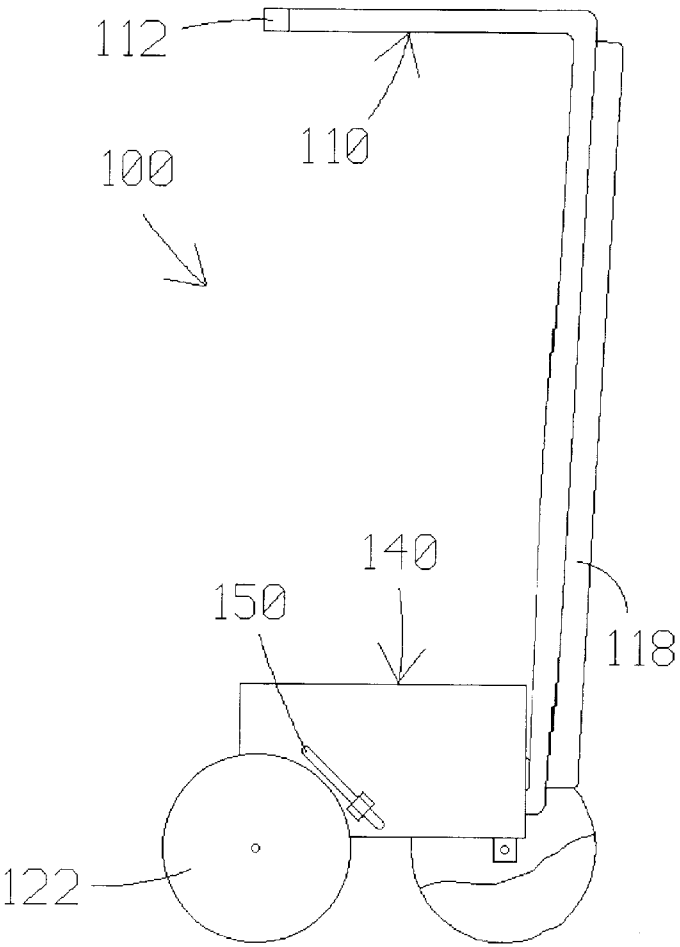
FIG. 1 is a side view of a first exercise system constructed according to the principles of the present invention and including a weight container, an exercise bench, and an aerobic step interconnected in a transport configuration.
Figure 2:
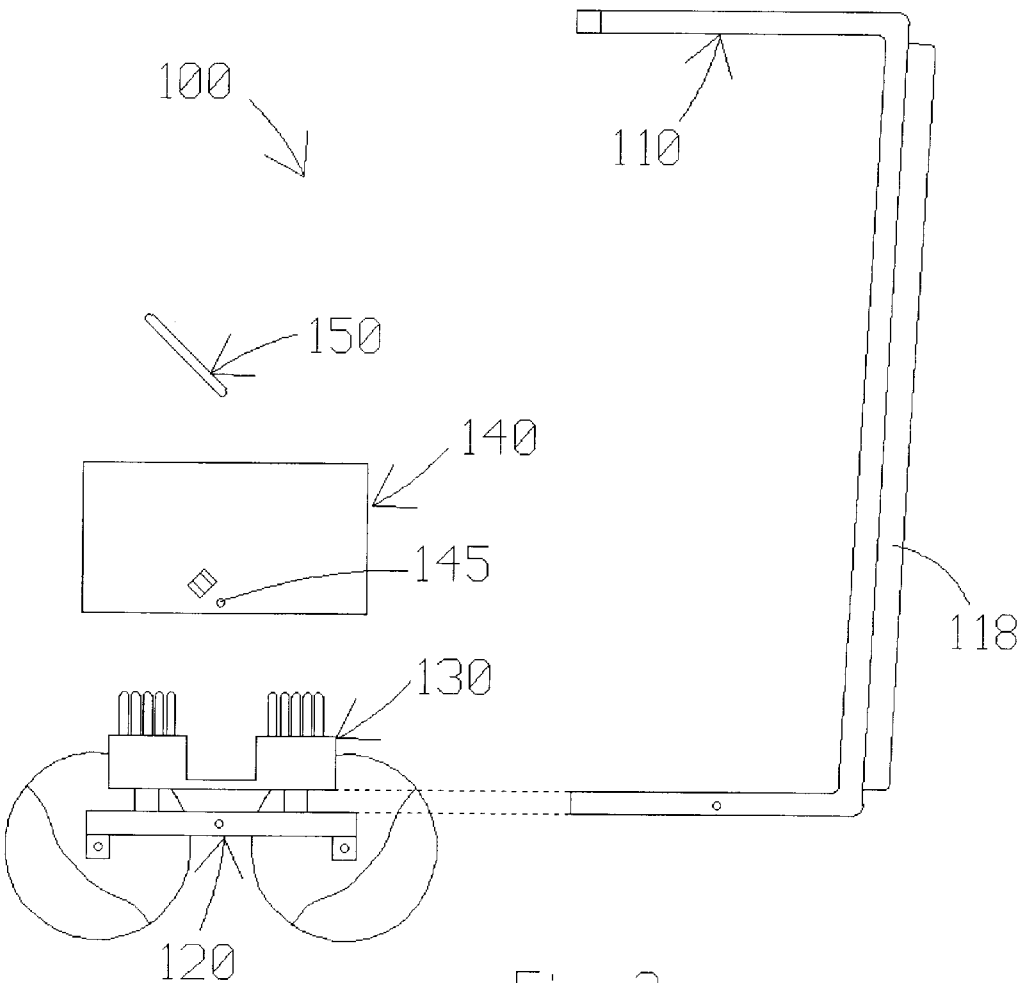
FIG. 2 is an exploded side view of the system of FIG. 1.
Figure 4C:
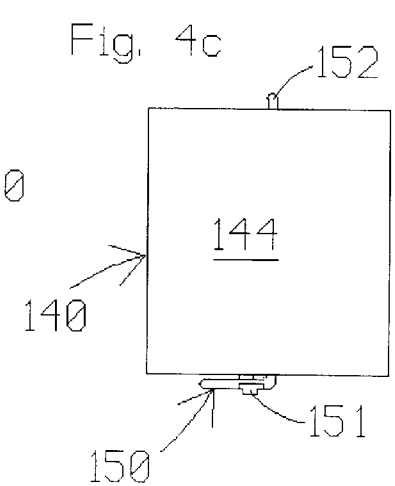
FIG. 4*c* is a top view of the aerobic step of FIG. 3*c;*

An exercise system constructed according to the principles of the present invention is designated as 100 in FIGS.

1–2. The system 100 may be described in terms of an exercise bench 110; a weight container 130 on a cart 120; an aerobic step 140; and a connecting bar 150 which selectively interconnects the other components in the configuration shown in FIG. 1.

Figure 3C:
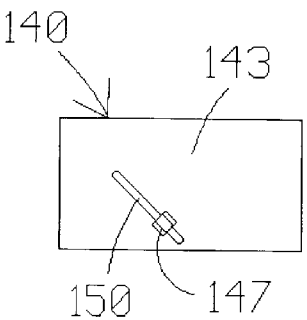
FIG. 3*c* is a side view of the aerobic step of FIG. 1 in an exercise configuration on a floor surface.
Figure 3B:
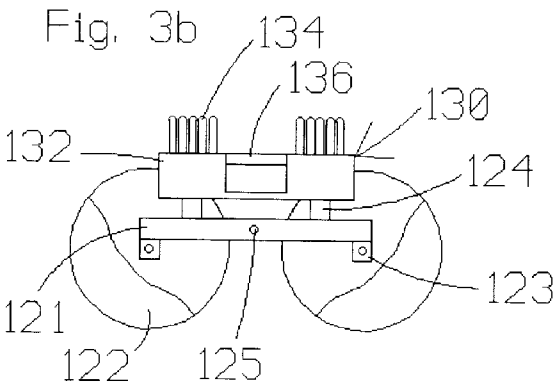
FIG. 3*b* is a side view of the weight container of FIG. 1 in an exercise configuration on a floor surface.
Figure 3A:
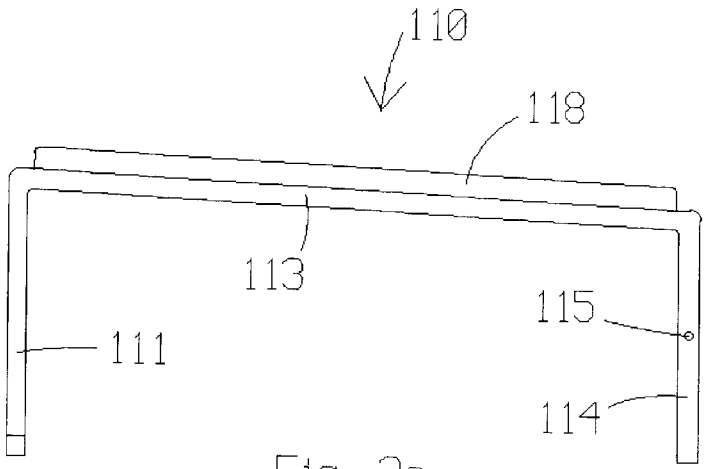
FIG. 3*a* is a side view of the exercise bench of FIG. 1 in an exercise configuration on a floor surface.

The bench 110 is shown by itself in FIGS. 3*a* and 3*b*. Generally speaking, the bench 110 includes a padded support 118 mounted on a support frame. When the bench 110 occupies the generally horizontal position shown in FIG. 3*a*, the support 118 is sized and configured to support a person in a supine position with feet resting on the floor on opposite sides of the bench 110. The support frame includes intermediate members 113 which underlie the support 118; first legs 111 which extend generally perpendicular away from the members 113 proximate a first end of the bench 110; and second legs 114 which extend generally perpendicular away from the members 113 proximate a second, opposite end of the bench 110. Feet 112 extend generally perpendicularly away from distal ends of respective legs 111 and in opposite directions away from one another. Holes 115 extend transversely through respective legs 114 to receive the connecting bar 150, as further explained below.

Figure 4B:
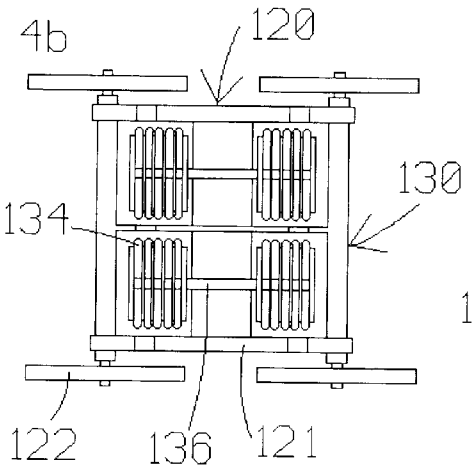
FIG. 4*b* is a top view of the weight container of FIG. 3*b;*
Figure 4A:
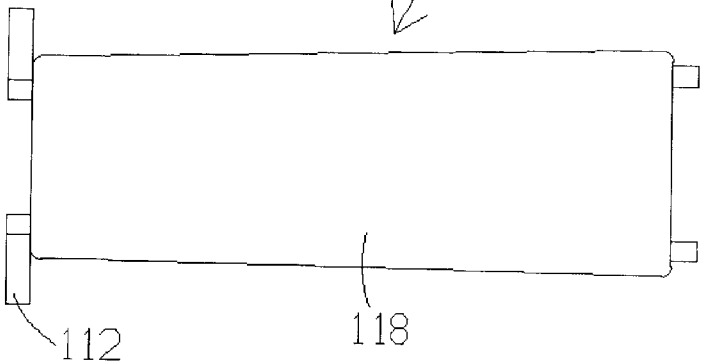
FIG. 4*a* is a top view of the exercise bench of FIG. 3*a;*

The cart 120 and the weight container 130 are shown in isolation in FIGS. 4*a* and 4*b*. Generally speaking, the cart 120 is designed to support the weight container 130 and to roll across a floor surface. The cart 120 includes a generally rectangular frame 121, and wheels 122 rotatably mounted on the frame 121 at respective corners thereof. Any suitable type of known locking arrangement may be provided on one or more of the wheels 122 to selectively prevent the cart 120 from rolling across a floor surface. A hole 125 extends transversely through the frame 121 to receive the connecting bar 150, as further explained below. The weight container 130 is mounted on the cart 120 and includes upwardly opening boxes or cradles 132 which are sized and configured to receive and support weight plates 134 in upwardly opening compartments or slots.

On the depicted embodiment 100, the plates 134, cradles 132, and associated dumbbell handles 136 are of the type disclosed in U.S. Pat. No. 5,839,997 to Roth et al., which is incorporated herein by reference. However, those skilled in the art will recognize that the present invention is not limited to this particular type of weight plate and/or weight plate holder. For example, other suitable weight plates and/or weight plate holders are disclosed in U.S. Pat. No. 4,529,198 to Hettick, Jr.; U.S. Pat. Nos. 4,822,034 and 5,284,463 to Shields; U.S. Pat. No. 5,637,064 and 5,769,762 to Towley III and Olson et al., all of which are incorporated herein by reference. Still more examples are disclosed in U.S. patent application Ser. No. 09/020,119, filed on Feb. 6, 1998; Ser. No. 09/246,825, filed on Feb. 8, 1999; Ser. No. 09/290,144, filed on Apr. 13, 1999, which are commonly owned together with the present invention, and which are also incorporated herein by reference. Moreover, the present invention can also be designed to accommodate entirely different types of weights, including, for example, traditional fixed weight dumbbells and/or weight plates of the type that fit onto the ends of a bar.

The aerobic step 140 is shown by itself in FIGS. 5*a* and 5*b*. The step 140 is sized and configured to support a person in a standing position with one or both feet positioned on the step 140 (when positioned as shown in FIG. 3*c*). The step 140 includes a sidewall or base portion 143 and an upwardly facing support surface 144. The step 140 may also be described as a downwardly opening box sized and configured to house the weight container 130. A hole 145 extends transversely through the base portion 143 to receive the connecting bar 150, as further explained below. Also, a catch or clip 147 is mounted on one side of the base portion 143, proximate the hole 145, to selectively maintain the connecting bar 150 in a latched position relative to the step 140.

The connecting bar 150 is an L-shaped bar having a relatively shorter segment 151 which functions both as a handle and as a latch, and a relatively longer segment 152 which functions to interconnect the other components. In this regard, the legs 114 of the bench 110 are sized and configured for insertion into the cart 120, between the relatively lower transverse members designated as 123 in FIG. 3*b* and the relatively higher transverse members designated as 124 in FIG. 3*b*. When the distal ends of the legs 114 encounter a stop proximate the front of the cart 120, the holes 115 in the legs 114 align with the hole 125 in the cart 120. Also, when the step 140 is positioned on top of the cart 120, between the wheels 122 and straddling the weight container 130, the hole 145 similarly aligns with the hole 125 in the cart 120. In this capacity, the step 140 provides the additional functions of both covering and containing the weight plates 134.

The aligned holes 145, 125, and 115 are sized and configured to receive the distal end of the longer segment 152 of the connecting bar 150. As the opposite, handle segment 151 approaches the sidewall 143 of the step 140, it is rotated toward a two o'clock position in order to clear both the catch 147 and the wheels 122. Upon full insertion, the handle segment 151 is rotated toward a ten o'clock position and snapped into place between the clip 147 and the sidewall 143 of the step 140. As shown in FIG. 1, when all of the components are properly interconnected, the entire system 100 is rollable across a floor surface. The transversely extending feet 112 on the generally vertical bench 110 are available as handles to facilitate maneuvering of the system 100 in this configuration.

Figure 7:
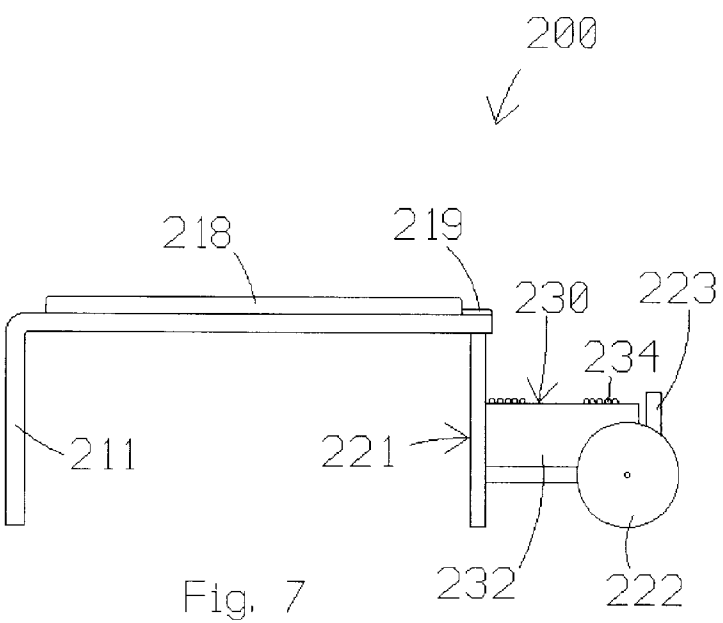
FIG. 7 is a side view of the weight container and exercise bench of FIG. 5 interconnected in an exercise configuration.
Figure 6:
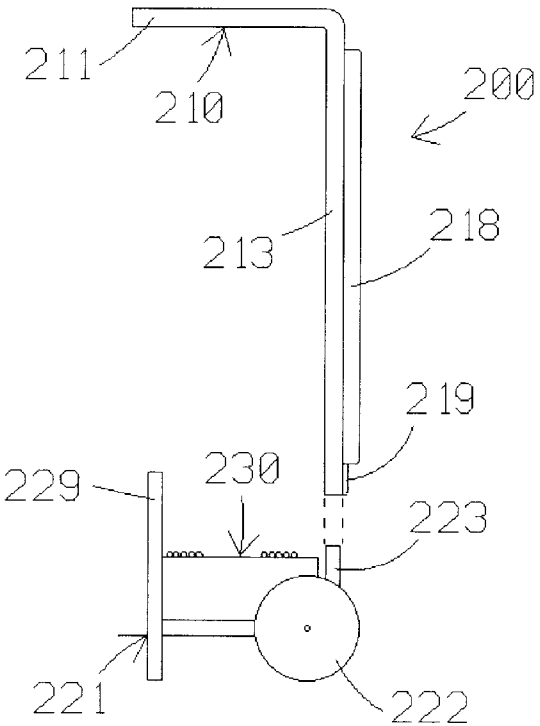
FIG. 6 is an exploded side view of the system of FIG. 5.
Figure 5:
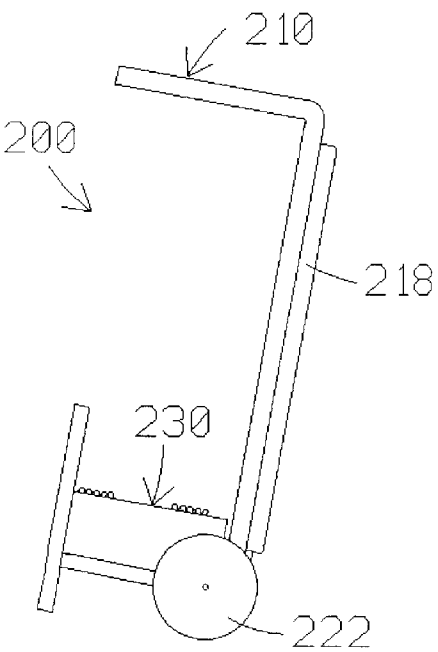
FIG. 5 is a side view of a second exercise system constructed according to the principles of the present invention and including a weight container and an exercise bench interconnected in a transport configuration.

Another exercise system constructed according to the principles of the present invention is designated as 200 in FIGS. 5–7. The system 200 may be described in terms of an exercise bench 210 and a weight container 230 which are selectively interconnected in either of two configurations. In a first configuration, shown in FIG. 5, the bench 210 occupies a generally vertical orientation, and the system 200 may be described as a two-wheel dolly. In a second configuration, shown in FIG. 7, the bench 210 occupies a generally horizontal orientation suitable for supporting a person in a supine position with feet resting on the floor on opposite sides of the bench 210.

Generally speaking, the bench 210 includes a padded support 218 mounted on a support frame. The support frame includes intermediate members 213 which underlie the support 218, and legs 211 which extend generally perpendicular away from the members 213 proximate a first end of the bench 210. A reinforcing plate 219 is secured across the ends of the members 213 opposite the legs 211.

The weight container 230 includes a support frame 221, and wheels 222 rotatably mounted on opposite sides of the frame 221 proximate a first end thereof. Legs 229 are mounted on an opposite end of the frame 221 and cooperate with the wheels 222 to maintain the system 200 in a stable position on an underlying floor surface. Any suitable type of known locking arrangement may be provided on one or more of the wheels 222 to selectively prevent the system 200 from rolling across the floor surface. Those skilled in the art will also recognize that the wheels 222 could be replaced by another pair of legs if a more stationary device is preferred. The weight container 230 further includes upwardly opening boxes or cradles 232 which are sized and configured to receive and support weight plates 234 like those described above with reference to the first embodiment 100.

The members 213 on the bench 210 are square tubes which are sized and configured to receive the upwardly extending, distal ends of the legs 229 or the posts 223 on the frame 221. With respect to the legs 229 (and with reference to FIG. 7), holes are provided in the downwardly facing sides of the tubes 213 to receive the upper ends of the legs 229. With respect to the posts 223 (and with reference to FIG. 6), the open ends of the tubes 213 fit over the upper ends of the posts 223. In each case, aligned holes may be provided in the overlapping members to accommodate a connecting bar for purposes of more securely interconnecting the two components.

Figure 8:
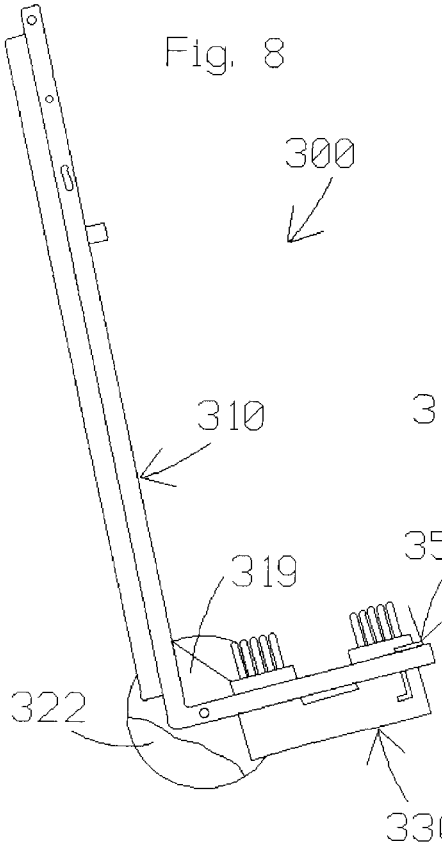
FIG. 8 is a side view of a third exercise system constructed according to the principles of the present invention and including a weight container and an exercise bench interconnected in a transport configuration.
Figure 9:
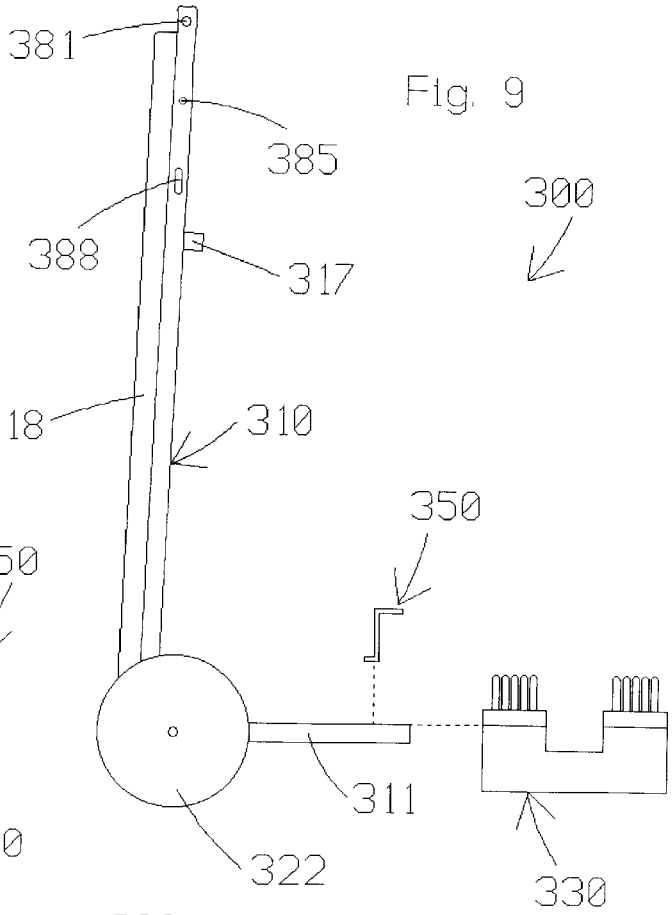
FIG. 9 is an exploded side view of the system of FIG. 8.
Figure 10:
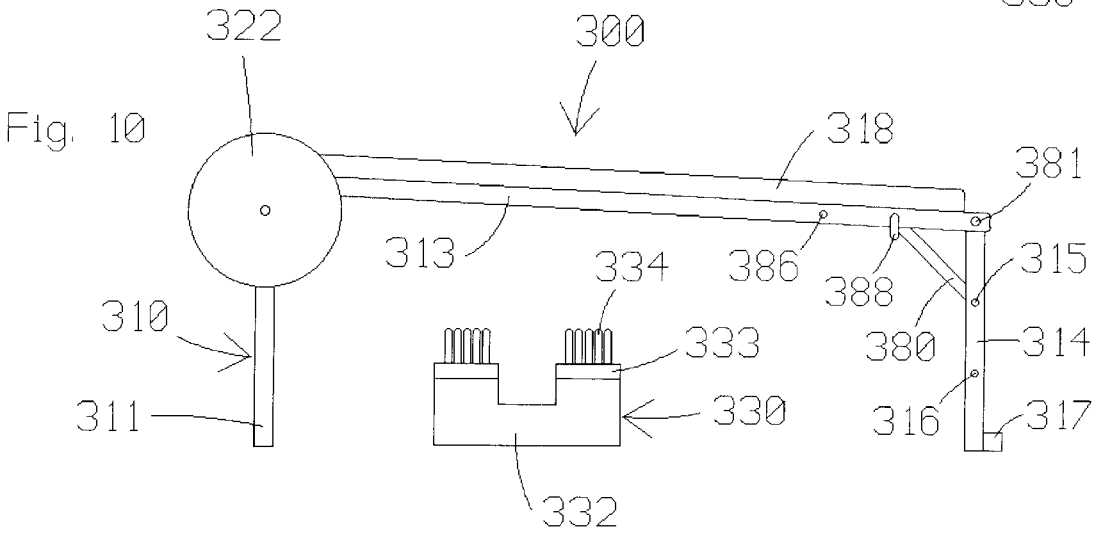
FIG. 10 is a side view of the weight container and the exercise bench in an exercise configuration on a floor surface.

Yet another exercise system constructed according to the principles of the present invention is designated as 300 in FIGS. 8–10. The system 300 may be described in terms of an exercise bench 310; a weight container 330; and a connecting bar 350 which selectively interconnects the other components in the configuration shown in FIG. 8.

Generally speaking, the bench 310 includes a padded support 318 mounted on a support frame. When the bench 310 occupies the generally horizontal position shown in FIG. 10, the support 318 is sized and configured to support a person in a supine position with feet resting on the floor on opposite sides of the bench 310. The support frame includes intermediate members 313 which underlie the support 318. First legs 311 extend generally perpendicular away from the members 313 proximate a first end of the bench 310. Reinforcing flanges 319 are interconnected between respective legs 311 and respective members 313. Wheels 322 are rotatably mounted on opposite sides of the frame proximate the juncture between the legs 311 and the members 313.

Second legs 314 are pivotally connected to respective members 313 proximate a second, opposite end of the bench 310 (at pin joints 381). A foot member 317 is interconnected between the opposite, lower ends of the legs 314 and extends outwardly in opposite directions therefrom. Brackets 380 have first ends which are pivotally connected to respective legs 314 at pin joints 315. When the bench 310 is configured as shown in FIG. 10, opposite, second ends of the brackets 380 are releasably connected to the members 313 by means of a connecting bar 388 inserted through holes 385 in the members 313 and aligned holes in the ends of the brackets 380. When the bench 310 is configured as shown in FIG. 9, the connecting bar 388 is inserted through holes 386 in the members 313 and aligned holes 316 in the legs 314, as well as through the holes in the movable ends of the brackets 380. In the latter configuration, the opposite ends of the foot 317 are available for use as handles in maneuvering the system 300 like a two-wheel dolly. Those skilled in the art will recognize that the collapsible legs 314 on this embodiment 300 may be provided on other embodiments, such as the first embodiment 100, and conversely, that the collapsible legs 314 on this embodiment 300 may be replaced by rigidly secured legs, such as those designated as 114 on the first embodiment 100.

The weight container 330 includes upwardly opening boxes or cradles 332 which are sized and configured to receive and support weight plates 334 similar to those described above with reference to the preceding embodiments. Ledges or shoulders 333 extend lengthwise along opposite sides of the weight container 330 to facilitate connection of same to the bench 310. In this regard, when the bench 310 occupies the generally vertical orientation shown in FIG. 9, the wheels 322 rest upon the floor, and the legs 311 on the bench 310 are maneuverable directly beneath the ledges 333 on the weight container 330. When the leading edges of the brackets 319 engage the near end of the weight container 330, a slot in one of the ledges 333 aligns with a slot in the leg 311 to receive the generally Z-shaped connecting bar 350, which is inserted through the aligned slots and rotated to discourage the legs 311 from dropping to the floor. The resulting configuration, shown in FIG. 8, may be described as a two-wheel dolly.

Still another exercise system constructed according to the principles of the present invention is designated as 400 in FIGS. 11–13. The system 400 may be described in terms of an exercise bench 410 and a weight container 430 which are interconnected and convertible into either of two configurations. In a first configuration, shown in FIG. 11, the bench 410 occupies a generally vertical orientation, and the system 400 may be described as a two-wheel dolly. In a second configuration, shown in FIG. 13, the bench 410 occupies a generally horizontal orientation suitable for supporting a person in a supine position with feet resting on the floor on opposite sides of the bench 410.

Generally speaking, the bench 410 includes a padded support 418 mounted on a support frame. The support frame includes intermediate members 413 which underlie the support 418, and legs 411 which extend generally perpendicular away from the members 413 proximate a first end of the bench 410.

The weight container 430 includes a support frame 421, and wheels 422 rotatably mounted on opposite sides of the frame 421 proximate a first end thereof. Legs 424 are mounted on an opposite end of the frame 421 and cooperate with the wheels 422 to maintain the system 400 in a stable position on an underlying floor surface. Those skilled in the art will recognize that any suitable type of known locking arrangement may be provided on one or more of the wheels 422 to selectively prevent the system 400 from rolling across the floor surface, or that the wheels 422 could be replaced by another pair of legs if a more stationary device is preferred. The weight container 430 further includes upwardly opening boxes or cradles 432 which are sized and configured to receive and support weight plates 434 like those described above with reference to the preceding embodiments.

Posts 423 extend upward on the frame 421 proximate the wheels 422. The members 413 are pivotally connected to respective posts 423 at pivot points 428. Extensions 417 of the members 413 extend beyond the pivots points 428 and are pivotally connected to respective brackets 470 at pivot points 478. Opposite ends of the brackets 470 are pivotally connected to respective slides 427 at pivot points 472. The slides 427 are movable along respective sides of the frame 421 between the legs 424 and the wheels 422. The slides 427 are sufficiently wide (and/or supplemented with spacers) to offset the lateral space occupied by the members 413, so that the brackets 470 occupy respective vertical planes extending perpendicular to the pivot axes 478 and 472. Holes 475 extend laterally through respective slides 427 and align with holes 425 through the frame 421 when the system 400 is configured as shown in FIG. 11 or FIG. 13. In either case, a connecting bar 455 may be inserted through the aligned holes 475 and 425 to latch the components relative to one another. Those skilled in the art will also recognize that a bias may be exerted against the bench 410 to offset a portion of its weight. For example, a torsion spring may be interconnected between the members 413 and the posts 423 to help urge the bench 410 toward a vertical orientation relative to the weight container 430.

Figures 14, 15, 16:
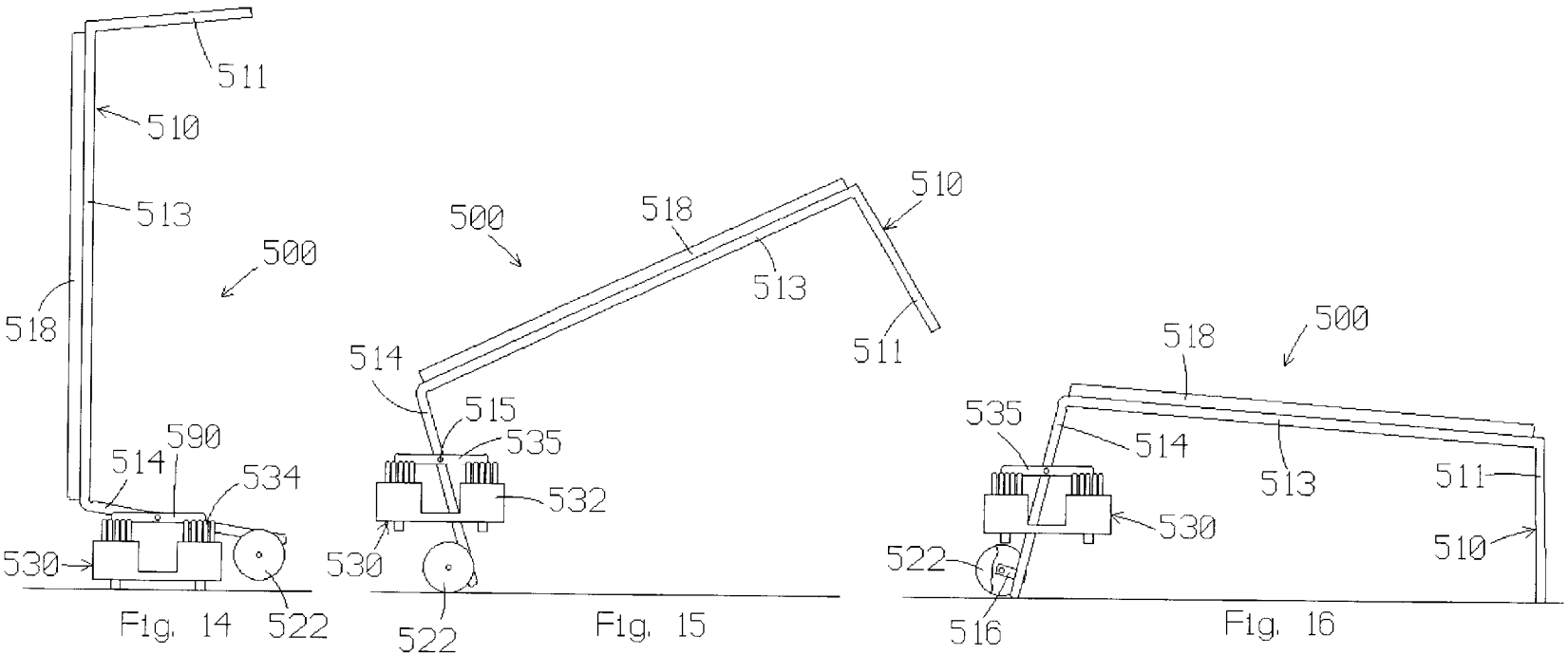
FIG. 14 is a side view of a fifth exercise system constructed according to the principles of the present invention and including a weight container and an exercise bench which are interconnected and shown in a storage configuration.
FIG. 15 is a side view of the system of FIG. 14 in a transport configuration.
FIG. 16 is a side view of the system of FIG. 14 in an exercise configuration.

Still another exercise system constructed according to the principles of the present invention is designated as 500 in FIGS. 14–16. The system 500 may be described in terms of an exercise bench 510 and a weight container 530 which are interconnected and convertible into three different configurations. In a first configuration, shown in FIG. 14, only the weight container 530 rests upon an underlying floor surface, and the system 500 is configured for storage. In a second configuration, shown in FIG. 15, only wheels 522 rest upon the floor surface, and the system 500 is configured for mobility. In a third configuration, shown in FIG. 16, only the bench 510 rests upon the floor surface, and the system 500 is configured for exercise purposes.

Generally speaking, the bench 510 includes a padded support 518 mounted on a support frame. When arranged as shown in FIG. 16, the support 518 is sized and configured to support a person in a supine position with feet resting on the floor on opposite sides of the bench 510. The support frame includes intermediate members 513 which underlie the support 518; legs 511 which extend generally perpendicular away from the members 513 proximate a first end of the bench 510; and legs 514 which extend generally perpendicular away from the members 513 proximate an opposite, second end of the bench 510. Posts 516 extend generally perpendicular away from the legs 514 proximate the lower, distal ends thereof, and the wheels 522 are rotatably mounted on the posts 516.

The weight container 530 includes upwardly opening boxes or cradles 532 which are sized and configured to receive and support weight plates 534 like those described above with reference to the preceding embodiments. The cradles 532 have upwardly disposed beams 535 which are pivotally connected to respective legs 514, intermediate the support 518 and the wheels 522, at pin joints 515. As a result of these pivotal connections, the cradles 532 tend to remain in a preferred, upright orientation regardless of the orientation of the bench 510. Also, the weight of the cradles 532 and the weight plates 534 biases the bench 510 "over center" and toward either the storage configuration shown in FIG. 14 or the exercise configuration shown in FIG. 16. As suggested by the preceding disclosure of other embodiments, a connecting bar may be inserted through aligned holes in the beams 535 and the legs 514 (in the region designated as 590 in FIG. 14) to lock the system 500 in the storage configuration. Those skilled in the art will also recognize that "over-center" biasing may be used on other embodiments, as well, and that the bench may be used for such purposes (with or without the weight container), depending on the particular arrangement.

Figure 18:
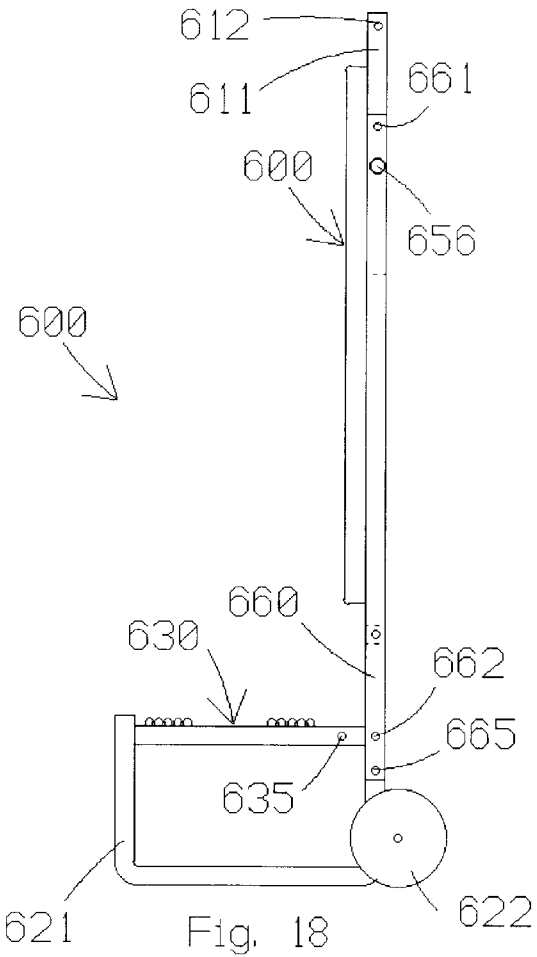
FIG. 18 is a side view of the system of FIG. 17 with the weight container and the exercise bench interconnected in a transport configuration.
Figure 17:
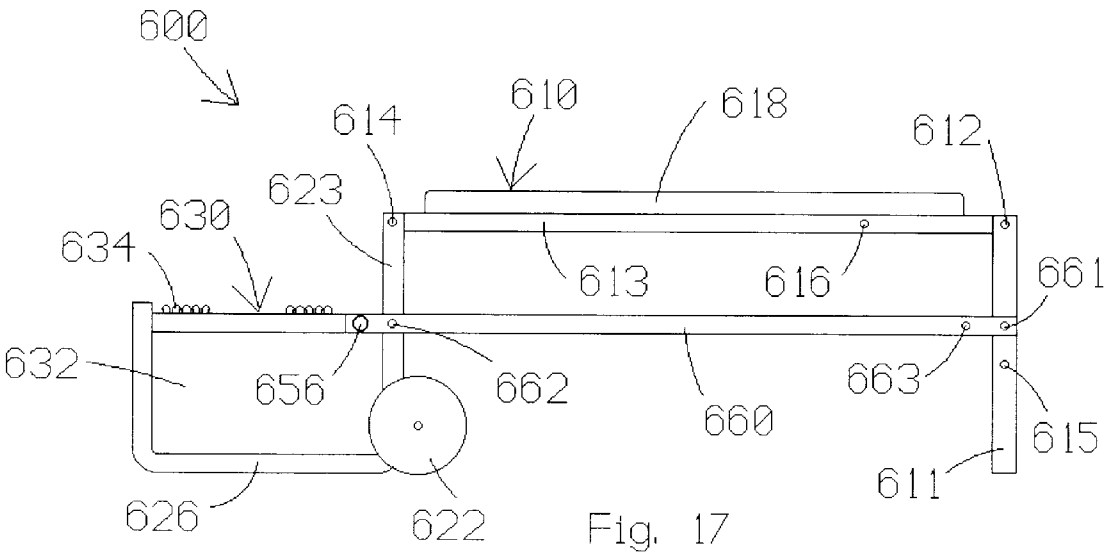
FIG. 17 is a side view of a sixth exercise system constructed according to the principles of the present invention and including a weight container and an exercise bench interconnected in an exercise configuration.

Still another exercise system constructed according to the principles of the present invention is designated as 600 in FIGS. 17–18. The system 600 may be described in terms of an exercise bench 610 and a weight container 630 which are interconnected and convertible into either of two configurations. In a first configuration, shown in FIG. 18, the bench 610 occupies a generally vertical orientation, and the system 600 may be described as a two-wheel dolly. In a second configuration, shown in FIG. 17, the bench 610 occupies a generally horizontal orientation suitable for supporting a person in a supine position with feet resting on the floor on opposite sides of the bench 610.

Generally speaking, the bench 610 includes a padded support 618 mounted on a support frame. The support frame includes intermediate members 613 which underlie the support 618, and legs 611 which are pivotally connected to the members 613 at pivot axis 612, proximate a first end of the bench 610. The intermediate members 613 are also pivotally connected to posts 623, proximate a second, opposite end of the bench 610, thereby defining pivot axis 614. Fourth bars or members 660 are also pivotally interconnected between respective posts 623 (at pivot axis 662) and respective legs 611 (at pivot axis 661), thereby creating respective four-bar linkages. As a result of this arrangement, the members 660 are constrained to remain parallel to the members 613, and the legs 611 are constrained to remain parallel to the posts 623, regardless of the orientation of the bench 610 relative to the weight container 630. When the system 600 is configured as shown in FIG. 17, the members 660 and 613 extend perpendicular to the legs 611 and the posts 623; and when the system 600 is configured as shown in FIG. 18, the members 660 and 613 extend parallel to the legs 611 and the posts 623.

The weight container 630 includes a support frame 621 having a floor engaging base 626, and floor engaging wheels 622 rotatably mounted on opposite sides of the frame 621 proximate a first end thereof. When the base 626 is resting flat upon an underlying floor surface, the system 600 remains stable and stationary. When the system 600 is folded into the configuration shown in FIG. 18 and tilted onto the wheels 622, the system 600 is rollable across the floor surface. Those skilled in the art will recognize that the wheels 622 are not required if a more stationary system is preferred. The weight container 630 further includes upwardly opening boxes or cradles 632 which are sized and configured to receive and support weight plates 634 like those described above with reference to the preceding embodiments.

The members 660 extend beyond the pivot axis 662 and are provided with connector holes 665 proximate their distal ends. A similarly sized hole 635 extends through the frame 621 at a like distance from the pivot axis 662. As a result, when the system 600 is configured as shown in FIG. 17, the holes 665 and 625 align to receive a connecting bar 656 which may be similar to the connecting bars described above with reference to the preceding embodiments. Those skilled in the art will recognize that other known fastening or latching arrangements may be substituted for the connecting bar (both on this embodiment and others described herein) without departing from the scope of the present invention. For example, spring biased latches could be mounted on one of the interacting members and could be selectively deflected to accommodate passage of the other member.

At the other end of the bench 610, holes 615 extend through the legs 611 at a first distance from the pivot axis 612, and at a second, relatively shorter distance from the pivot axis 661. Similarly sized holes 663 extend through the members 660 at the same second distance from the pivot axis 661, and similarly sized holes 616 extend through the members 613 at the same first distance from the pivot axis 612. As a result, when the system 600 is folded into the configuration shown in FIG. 18, the holes 663, 615, and 616 align to receive the connecting bar 656.

In each of FIGS. 17 and 18, the connecting bar 656 selectively locks the four-bar linkage in the depicted configuration. On this embodiment 600, the connecting bar 656 is sufficiently long to accommodate grips which are made of rubber and are sized and configured to slide onto opposite ends of the bar 656. The grips serve as handles and/or foot rests (depending upon the configuration of the system 600) and also maintain the bar in a locked position. Those skilled in the art will also recognize that a damper may be interconnected between members of the four-bar linkage to slow the descent of the bench 610 from the vertical orientation shown in FIG. 18 to the horizontal orientation shown in FIG.

17, and/or that a spring may be interconnected between members of the four-bar linkage to help lift the bench 610 from the horizontal orientation shown in FIG. 17 to the vertical orientation shown in FIG. 18.

Those skilled in the art will recognize that the present invention is not limited to the particular type of exercise bench described with reference to the foregoing embodiments. For example, the system 600 may be modified to include a two-piece is body support 681, 682 and/or barbell posts 624, as shown on the system designated as 600' in FIG. 19. The posts 624 extend upward from the base 626 and upward beyond the pivotal connection with the intermediate members 613' (at pivot axis 614). Brackets 625 are mounted on top of the posts 624 to receive and support a barbell. When the system 600' is folded in the manner suggested by FIG. 18, the elongated posts 624 fit between the members 613' and the members 660 and beneath the legs 611.

Figure 19:
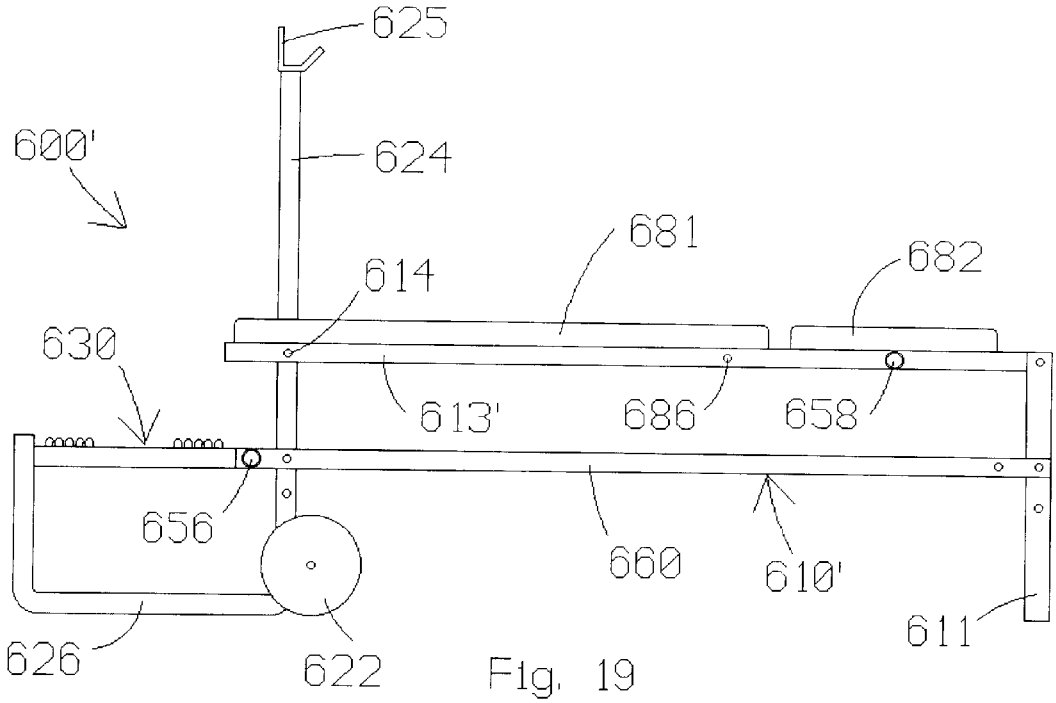
FIG. 19 is a side view of the system of FIG. 17 modified to provide a barbell support and a two-piece bench.
Figure 20:
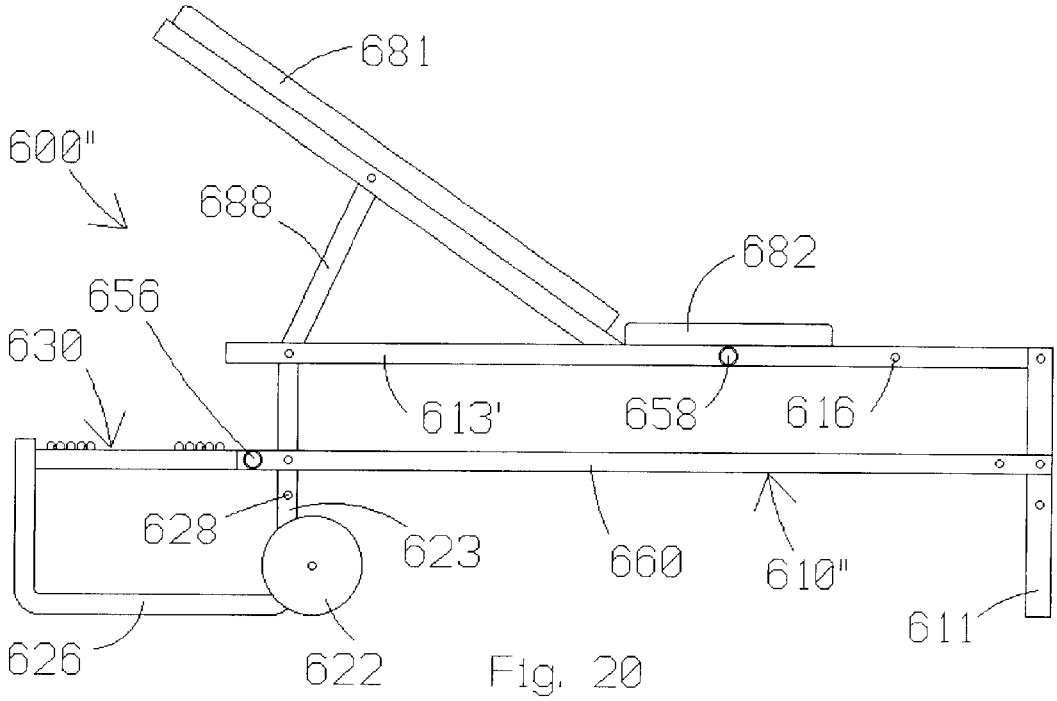
FIG. 20 is a side view of the system of FIG. 17 modified to provide a two-piece bench which is selectively inclined.

FIG. 20 shows a system 600" which includes the two-piece body support 681, 682, but not the barbell posts 624. The smaller body support 682 is movable along the intermediate supports 613', and the larger body support 681 is pivotal relative to the smaller body support 682. A brace 688 is pivotally interconnected between the larger body support 681 and the relative shorter posts 623 to selectively support the larger body support 681 in an inclined orientation relative to the intermediate supports 613'. A connecting bar 658 inserts through holes 616 or 686 in the supports 613' and aligned holes in the smaller body support 682 to maintain the supports 681, 682 in either configuration (FIG. 19 or 20 respectively). The connecting bar 658 may also be inserted through the aligned holes in the supports 613' and the legs 611 to maintain either system 600' or 600" in a folded configuration. Additional holes 628 are provided in the posts 623 or 624 to receive the other connecting bar 656 when either system 600' or 600" is folded.

Those skilled in the art will recognize that the present if invention may be applicable to other sorts of body supports, in addition to exercise benches. For example, still another exercise system constructed according to the principles of the present invention is designated as 700 in FIGS. 21–24. The system 700 may be described in terms of a weight container 730 and an aerobic step 750 which are interconnected by a hinge 752 and supported by a frame 721 provided with wheels 722 on one end thereof.

The support frame 721 has a floor engaging base 726, and floor engaging wheels 722 rotatably mounted on opposite sides of the frame 721. When the base 726 is resting flat upon an underlying floor surface, the system 700 remains stable and stationary. When the system 700 is tilted onto the wheels 722, the system 700 is rollable across the floor surface. Those skilled in the art will recognize that the wheels 722 are not required if only a stationary device is preferred. The weight container 730 further includes upwardly opening boxes or cradles 732 which are sized and configured to receive and support weight plates 734 and associated dumbbell handles like those described above with reference to the first embodiment 100.

Figure 24:
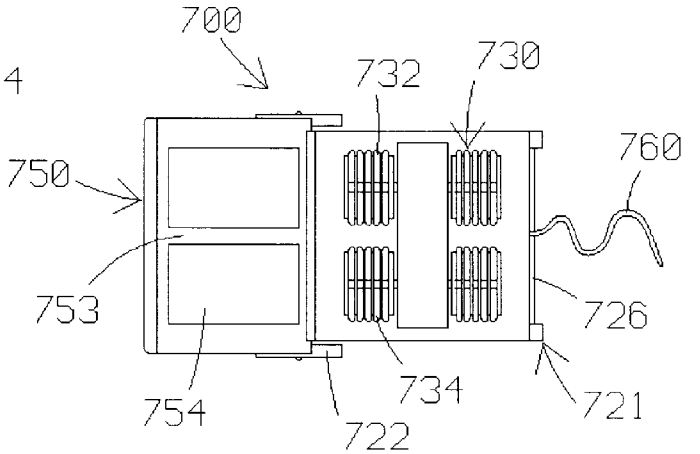
FIG. 24 is a top view of the system of FIG. 23.
Figure 23:
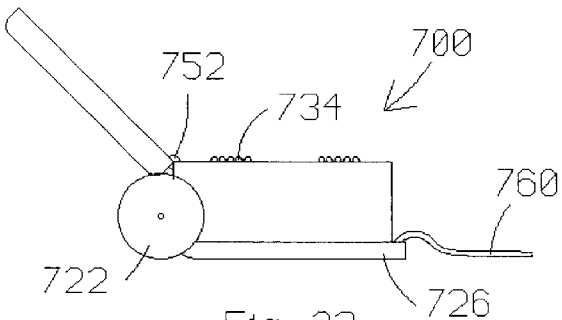
FIG. 23 is a side view of the system of FIG. 21 with the weight container in an exercise configuration on a floor surface.
Figure 22:
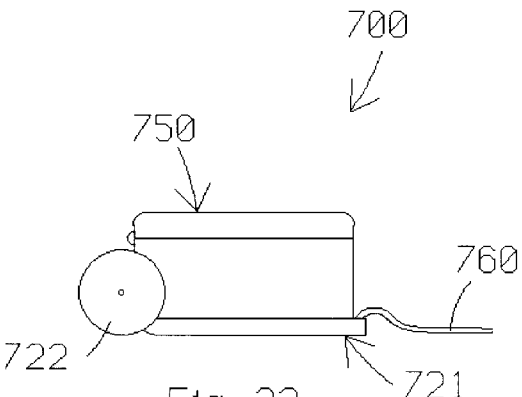
FIG. 22 is a side view of the system of FIG. 21 with the aerobic step in an exercise configuration on a floor surface.

Generally speaking, the step 750 includes a horizontal bearing surface or platform disposed on top of the weight container 730. Downwardly opening compartments 754 are formed in the platform to align with the upwardly opening compartments in the weight container 730 and accommodate upper portions of the weights 734. A reinforcing beam 753 extends between the two compartments 754 and rests on a middle portion of the weight container 730 when the system 700 is configured as shown in FIG. 22. As shown in FIGS. 23 and 24, the platform is sized and configured to rest against the wheels 722 when opened as far as possible.

Figure 21:
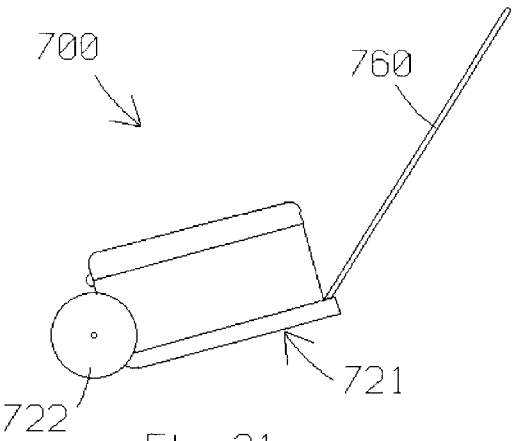
FIG. 21 is a side view of a seventh exercise system constructed according to the principles of the present invention and including a weight container and an aerobic step interconnected in a transport configuration.

The foregoing arrangement 700 may be readily converted from a first configuration, shown in FIGS. 23–24, wherein the weights 734 are available for use, but the step 750 is not immediately available for use; to a second configuration, shown in FIG. 22, wherein the step 750 is available for use, but the weights 734 are not immediately available for use; to a third configuration, shown in FIG. 21, wherein only the wheels 722 are in contact with the floor surface, and neither the weights 734 nor the step 750 is immediately available for use. In this last configuration, a flexible cord 760, which is attached to the frame 721, facilitates maneuvering of the system 700 across a floor surface.

Given the foregoing system 700 and/or the first embodiment 100, those skilled in the art will recognize additional ways to combine an aerobic step and a weight container in order to practice the present invention. For example, an aerobic step may be sized and configured to straddle a weight container when both are resting upon a floor surface. On another alternative embodiment, the weight containers) may move like a drawer into and out of the aerobic step.

The foregoing description and accompanying drawings also suggest various folding bench systems which may be practiced in the absence of a weight container. For example, the system 600 shown in FIGS. 17–18 may be modified somewhat to arrive at the apparatus designated as 800 in FIGS. 25–27. In a first configuration, shown in FIG. 25, the apparatus 800 occupies an exercise bench configuration; in a second configuration, shown in FIG. 26, the apparatus 800 occupies a transport configuration; and in a third configuration, shown in FIG. 27, the bench 800 occupies a storage configuration. The apparatus 800 is shown with optional members 833 to illustrate that it may be used as a two-wheel dolly when in the second configuration; and optional barbell supports 825 to illustrate that it may used for barbell exercises, as well as dumbbell exercises, when in the first configuration.

Generally speaking, the bench portion 810 of the apparatus (excluding the optional members 833) includes a padded support 818 mounted on a support frame. The support frame includes intermediate members 813 which underlie the support 818, and legs 811 which are pivotally connected to the members 813 at pivot axis 812, proximate a first end of the bench 810. The intermediate members 813 are also pivotally connected to posts 824, proximate a second, opposite end of the bench 810, thereby defining pivot axis 814. Fourth bars or members 860 are also pivotally interconnected between respective posts 824 (at pivot axis 862) and respective legs 811 (at pivot axis 861), thereby creating respective four-bar linkages. As a result of this arrangement, the members 860 are constrained to remain parallel to the members 813, and the legs 811 are constrained to remain parallel to the posts 823 in all of the available configurations. When the apparatus 800 is configured as shown in FIG. 25, the members 860 and 813 extend perpendicular to the legs 811 and the posts 824; and when the apparatus 800 is configured as shown in FIG. 26 of FIG. 27, the members 860 and 813 extend parallel to the legs 811 and the posts 824 (and the overall height of the apparatus 800 is less than four times the width of the structural members 811, 813, 824, and 860, and less than four times the depth of the same structural members).

The members 860 extend beyond the pivot axis 862 and are provided with connector holes proximate their distal ends. A similarly sized hole extends through brackets 826 on the posts 824 at a like distance from the pivot axis 862. As a result, when the apparatus 800 is configured as shown in FIG. 25, a connecting bar 856 may be inserted through aligned holes in the members 860 and the brackets 826. At the other end of the bench 810, holes 815 extend through the legs 811 at a first distance from the pivot axis 812, and at a second, relatively shorter distance from the pivot axis 861. Similarly sized holes 863 extend through the members 860 at the same second distance from the pivot axis 861, and similarly sized holes 816 extend through the members 813 at the same first distance from the pivot axis 812. As a result, when the apparatus 800 is folded into the configuration shown in FIG. 26 or FIG. 27, the holes 863, 815, and 816 align to receive the connecting bar 856.

Figure 25:
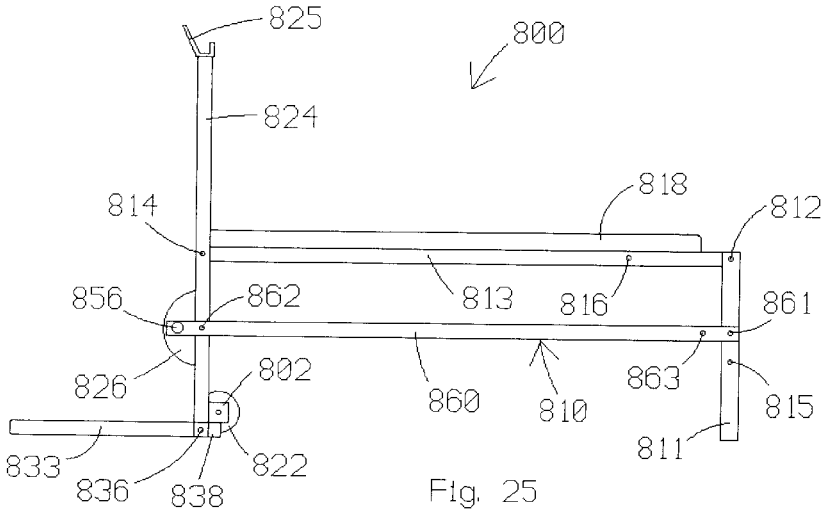
FIG. 25 is a side view of an eighth exercise system constructed according to the principles of the present invention and configured as an exercise bench.
Figure 26:
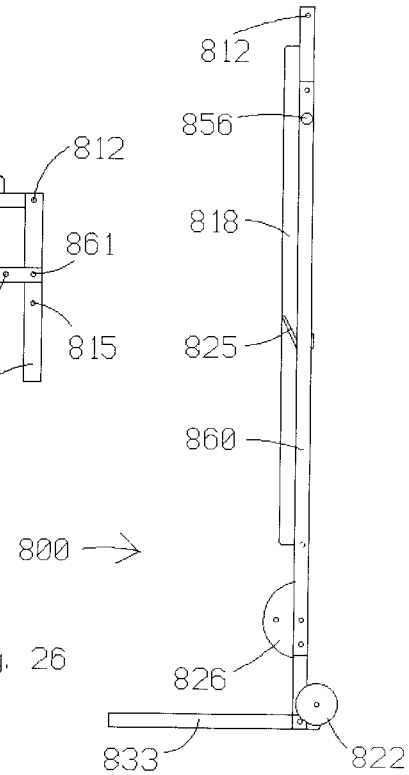
FIG. 26 is a side view of the system of FIG. 25 configured as a two-wheel dolly.
Figure 27:
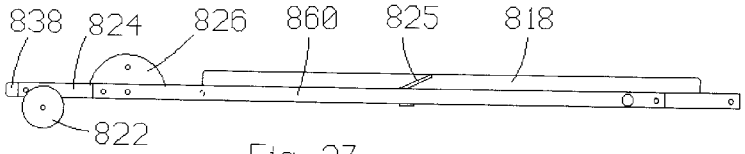
FIG. 27 is a side view of the system of FIG. 25 configured for storage.

In each of FIGS. 25–27, the connecting bar 856 selectively locks the four-bar linkage in the depicted configuration. Like on the embodiment 600, the connecting bar 856 is sufficiently long to accommodate grips which are made of rubber and are sized and configured to slide onto opposite ends of the bar 856. The grips serve as handles and/or foot rests (depending upon the configuration of the apparatus 800) and also maintain the bar in a locked position.

A bar 802 is secured transversely between the posts 824 proximate the lower ends thereof, and relatively small diameter wheels 822 are rotatably mounted on opposite ends of the bar 802. The wheels are sized and positioned to be spaced above the floor when the apparatus 800 occupies the configuration shown in FIG. 25. When the apparatus 800 occupies the configuration shown in FIG. 26, the apparatus 800 may be tilted rearward to bring the wheels 822 into contact to the floor (with the extreme completely tilted apparatus 800 shown in FIG. 27).

The members 833 are pivotally connected to the posts 824 proximate the lower ends of the latter, thereby defining pivot axis 836. An extension 838 of each member 833 bears against the cross-bar 802 when the apparatus is configured as shown in FIG. 25 or FIG. 26, thereby countering downward force applied against the members 833 on the opposite side of the pivot axis 836. When the members 833 are rotated to the orientation shown in FIG. 27, the extensions 838 project beyond the posts 824, and the members 833 rest on the cross-bar 802 and between the posts 824.

Those skilled in the art will recognize that the present invention is not limited to the embodiments described above and/or depicted in the accompanying drawings. Moreover, it is understood that various features may be implemented and/or combined in various ways as a matter of design choice. The system 600 is considered to be particularly advantageous to the extent that it provides a relatively compact and complete free weight exercise apparatus which readily converts between operative and storage configurations. However, the present invention is not limited to any one embodiment and in fact, may be expressed in various terms which are broad enough to cover a variety of embodiments and/or applications.

Among other things, the present invention may be described in terms of an exercise apparatus, comprising: a base member adapted to rest upon a floor surface and to provide at least one upwardly opening compartment; free weights disposed inside the compartment and movable upwardly out of the compartment; and a bench member sized and configured to support a person in a supine position and movable relative to the base member between a first position, wherein the bench member is vertically oriented and supported entirely by the base member, and a second position, wherein the bench member is horizontally oriented and in direct contact with the floor surface. The bench member may be pivotally connected to the base member and pivot about a horizontal pivot axis relative to the base member. The base member and the bench member may be interconnected to define a four-bar linkage. A connecting bar may be inserted through aligned holes in overlapping links of the four-bar linkage to selectively lock the bench in the first position relative to the base member. Handles may be mounted on opposite ends of the connecting bar to facilitate maneuvering of the apparatus when the bench occupies the first position relative to the base member. The connecting bar may be inserted through aligned holes in overlapping links of the four-bar linkage to selectively lock the bench in the second position relative to the base member.

The bench member may include an intermediate support which is secured beneath a padded member, and a leg which extends perpendicular to the intermediate support and engages the floor surface when the bench occupies the second position. The leg may be arranged to extend parallel to the intermediate support when the bench occupies the first position. The padded member may be arranged to face upward when the bench member occupies the second position, and the padded member faces toward the base member when the bench member occupies the first position. An additional support may be pivotally interconnected between the leg and the base member and extend parallel to the intermediate support.

Any of the foregoing embodiments or combinations may also include a dumbbell handle disposed proximate the weights, and means for selectively connecting the weights to the dumbbell handle. Any of the foregoing embodiments and/or combinations may further include wheels rotatably mounted on opposite sides of the base member in such a manner that when the bench member occupies the first position relative to the base member, the apparatus may be tilted relative to the floor surface to an orientation wherein only the wheels are in contact with the floor surface.

In another respect, the present invention may be described in terms of an exercise bench of the type that supports a person in a supine position above a horizontal floor surface, comprising: a first frame member which includes rotatable wheels; a second frame member which includes a planar member sized and configured to support a person's back, wherein the first frame member and the second frame member cooperate to support the planar member in a vertical orientation when the second frame member rests entirely on the first frame member, and to support the planar member in a horizontal orientation when at least part of the second frame member rests directly on the floor surface.

The second frame member of the foregoing paragraph may be described in terms of a first bar which is secured to the planar member, and a second bar which extends perpendicular to the first bar and engages the floor surface when the planar member occupies the horizontal orientation. The first bar may be described as pivotally connected to the first frame member, and/or a securing means may be provided for releasably securing the first bar relative to the first frame member when the planar member occupies the vertical orientation and/or when the planar member occupies the horizontal orientation. Furthermore, the planar member may be padded on one side, which side faces upward when the planar member occupies the horizontal orientation, and toward the weight container when the planar member occupies the vertical orientation.

The wheels may be arranged to remain in contact with the floor surface regardless of the orientation of the planar member, and/or the wheels may be rotatably mounted on opposite sides of the first frame member proximate a first end thereof. The exercise bench may be configured so that its center of gravity is disposed vertically above the wheel axis when the planar member occupies the vertical orientation, and only the wheels are in contact with the floor surface. The foregoing bench may be provided with a downwardly extending leg mounted on the first frame member proximate an opposite, second end thereof.

A weight container may be mounted on the first frame member and provide at least one compartment. The weight container may be arranged to remain in a generally upright orientation and/or to remain accessible from above, regardless of the orientation of the planar member. The weight container may be configured to support at least one group of weight plates arranged on edge in horizontal alignment with one another with gaps defined therebetween.

The present invention may also be described in terms of an exercise bench of the type that supports a person in a supine position above a horizontal floor surface, comprising: a weight container which includes at least one compartment and is configured to rest in a stable position upon the floor surface; and a frame member which includes a planar member sized and configured to support a person's back, wherein the weight container and the frame member cooperate to support the planar member in a generally vertical orientation when the frame member rests entirely on the weight container, and to support the planar member in a generally horizontal orientation when at least part of the frame member rests directly on the floor surface.

The present invention may alternatively be described in terms of an exercise apparatus of the type that supports a person above a horizontal floor surface, comprising: a base which includes rotatable wheels and a weight container having at least one compartment; and a frame member which includes a planar member sized and configured to support a person, wherein the frame member is movable relative to the base between a first position, wherein the planar member occupies an inoperative orientation, and only the wheels engage the floor surface, and a second position, wherein the planar member occupies an operative orientation, and more than just the wheels engage the floor surface.

The present invention may alternatively be described in terms of an exercise apparatus, comprising: a body supporting member; a first means for supporting the body supporting member in a generally horizontal orientation relative to an underlying horizontal floor surface; a second means for supporting weight plates within a compartment; and a third means for selectively mounting the body supporting member in a generally vertical orientation on the second means.

The present invention may also be described in terms of a method of using an exercise bench relative to a horizontal floor surface, comprising the steps of: providing a frame with a planar member sized and configured to support a person's back; providing a base adapted to rest upon a floor surface; placing the base on the floor surface; and selectively moving the frame relative to the base between a first position, wherein the frame is supported entirely by the base, and the planar member occupies a generally vertical orientation, and a second position, wherein at least part of the frame is supported directly by the floor surface, and the planar member occupies a generally horizontal orientation.

Still another way to describe the present invention is in terms of a method of transforming an exercise bench into a weight cart. A base member is provided to rest upon a floor surface with at least one upwardly opening compartment. Free weights are sized and configured to rest inside the compartment. A bench member is sized and configured to support a person in a supine position. Wheels are provided on at least one of the bench member and the base member. The bench member is moved relative to the base member from a first configuration, wherein the bench member is horizontally oriented and in direct contact with the floor surface, to a second configuration, wherein the bench member extends vertically upward from the base member, and the wheels are in direct contact with the floor surface.

The foregoing description and accompanying drawings will enable persons skilled in the art to make and use the present invention in various forms. In construing the nature and scope of the present invention, no special significance should attach to the fact that some of the features and/or advantages are discussed and/or shown in greater detail than others. For example, the wheels provide a necessary function on certain embodiments, but they are often shown in phantom lines to facilitate the depiction of other elements and/or to emphasize that the wheels could be omitted on alternative embodiments. Also, some terms are used with the understanding that they will be interpreted in common sense fashion so as to assess appropriate scope to the subject invention. For example, geometric terms such as horizontal and vertical should be construed in a relatively broad sense to include orientations within thirty degrees of same. In conclusion, the claims that follow should be read with the foregoing in mind to determine the scope of the present invention.

What is claimed is:

1. A free weight exercise system, comprising:

a portable base member having at least one wheel and adapted to remain free standing on a floor surface and to provide at least one upwardly opening compartment;

first and second dumbbells disposed in lateral alignment with one another inside the at least one compartment and movable upwardly out of the at least one compartment; and a bench member sized and configured to support a person in a supine position and movable relative to the base member between a first position, wherein the bench member is vertically oriented and supported entirely by the base member, and a second position, wherein the bench member is horizontally oriented and in direct contact with the floor surface, and clearance is provided for a person to lift the dumbbells upwardly from the at least one compartment while leaning over an area defined between respective handles on the dumbbells.

2. The exercise system of claim 1, wherein the at least one wheel includes first and second wheels rotatably mounted on opposite sides of the base member in such a manner that when the bench member occupies the first position relative to the base member, the apparatus may be tilted relative to the floor surface to an orientation wherein only the wheels are in contact with the floor surface.

3. The exercise system of claim 2, wherein the base member and the bench member cooperate to define a four-bar linkage.

4. The exercise system of claim 3, wherein a connecting bar is inserted through aligned holes in overlapping links of the four-bar linkage to selectively lock the bench in the first position relative to the base member.

5. The exercise system of claim 3, wherein a connecting bar is inserted through aligned holes in overlapping links of the four-bar linkage to selectively lock the bench in the second position relative to the base member.

6. The exercise system of claim 2, wherein the bench member includes a padded member which faces upward when the bench member occupies the second position, and which faces toward the base member when the bench member occupies the first position.

7. The exercise system of claim 6, wherein the bench member includes an intermediate support which is secured beneath the padded member, and a leg which extends perpendicular to the intermediate support and engages the floor surface when the bench occupies the second position.

8. The exercise system of claim 7, wherein an additional support is pivotally interconnected between the leg and the base member and extends parallel to the intermediate support regardless of the orientation of the bench member relative to the base member.

9. The exercise system of claim 1, wherein the base member and the bench member cooperate to define a four-bar linkage.

10. The exercise system of claim 9, wherein a connecting bar is inserted through aligned holes in overlapping links of the four-bar linkage to selectively lock the bench in the first position relative to the base member.

11. The exercise system of claim 1, wherein the bench member is pivotally connected to the base member and pivots about a horizontal pivot axis relative to the base member.

12. The exercise system of claim 1, wherein each of the dumbbells includes a dumbbell handle disposed proximate a plurality of weights, and means for selectively connecting the weights to the dumbbell handle.

13. The exercise system of claim 1, wherein the bench member includes an intermediate support which is secured beneath a padded member, and a leg which extends perpendicular to the intermediate support and engages the floor surface when the bench occupies the second position.

14. The exercise system of claim 13, wherein the leg extends parallel to the intermediate support when the bench occupies the first position.

15. The exercise system of claim 13, wherein th padded member faces upward when the bench member occupies the second position, and the padded member faces toward the base member when the bench member occupies the first position.

16. The exercise system of claim 13, wherein an additional support is pivotally interconnected between the leg and the base member and extends parallel to the intermediate support.

17. The exercise system of claim 1, wherein the base member has a height, and the bench member has a length, and the length of the bench member is greater than the height of the base member.

18. The exercise system of claim 1, wherein the at least one compartment is configured to hold the dumbbells adjacent to one another.

19. The exercise system of claim 1, wherein the at least one compartment is configured to hold the dumbbells on opposite sides of the bench.

20. An exercise apparatus, comprising:

a base member adapted to rest upon a floor surface and to provide at least one upwardly opening compartment;

free weights disposed inside the compartment and movable upwardly out of the compartment;

a bench member sized and configured to support a person in a supine position and movable relative to the base member between a first position, wherein the bench member is vertically oriented and supported entirely by the base member, and a second position, wherein the bench member is horizontally oriented and in direct contact with the floor surface; and a connecting bar configured for insertion through aligned holes in overlapping portions of the base member and the bench member to selectively lock the bench member in the first position relative to the base member, wherein handles are mounted on opposite ends of the connecting bar to facilitate maneuvering of the apparatus when the bench occupies the first position relative to the base member.

21. The exercise apparatus of claim 20, wherein the base member and the bench member cooperate to define a four-bar linkage and wherein the connecting bar is alternatively inserted through aligned holes in overlapping links of the four-bar linkage to selectively lock the bench in the second position relative to the base member.

22. The exercise apparatus of claim 20, further comprising wheels rotatably mounted on opposite sides of the base member in such a manner that when the bench member occupies the first position relative to the base member, the apparatus may be tilted relative to the floor surface to an orientation wherein only the wheels are in contact with the floor surface.

23. A method of transforming an exercise bench into a weight cart, comprising the steps of:

providing a base member adapted to remain free standing on a floor surface with at least one upwardly opening compartment;

providing first and second dumbbells sized and configured to rest inside the at least one compartment;

placing the dumbbells in the at least one compartment, wherein the dumbbells cooperate to define a center of mass therebetween;

providing a bench member sized and configured to support a person in a supine position;

providing wheels on at least one of the bench member and the base member;

selectively moving the bench member relative to the base member to switch between a first configuration that defines an exercise bench, wherein the bench member is horizontally oriented and in direct contact with the floor surface, and the dumbbells are laterally aligned with one another inside the at least one compartment, and a second configuration that defines a weight cart, wherein the bench member extends vertically upward from the base member, the dumbbells are laterally aligned with one another inside the at least one compartment, and the wheels are in direct contact with the floor surface; and selectively lifting the dumbbells upwardly out of the at least one compartment while leaning over the center of mass.

24. The method of claim 23, wherein the bench member is provided with leg members that are sized and configured for use as outwardly projecting handles to facilitate maneuvering of the weight cart.

25. The method of claim 23, wherein the moving step involves temporary separation of the bench member from the base member.

26. The method of claim 23, wherein the bench member remains connected to the base member during the moving step.

27. The method of claim 23, wherein the moving step leaves the exercise bench in a stable, self-supported position on the floor surface, and alternatively leaves the weight cart in a stable, self-supported position on the floor surface.

28. A free weight exercise system, comprising:

a portable base member having at least one wheel and adapted to remain free standing on a floor surface and to provide at least one upwardly opening compartment;

a bench member sized and configured to support a person in a supine position, wherein the base member alternatively supports the bench member in a first position, wherein the bench member is vertically oriented, and a second position, wherein the bench member is horizontally oriented; and a first dumbbell and a second dumbbell disposed side by side inside the at least one compartment and simultaneously movable upwardly out of the at least one compartment when the bench member occupies either said position.

29. A method of transforming an exercise bench into a free standing weight cart, comprising the steps of:

providing a base member adapted to provide at least one upwardly opening compartment while freely standing on a floor surface;

providing first and second dumbbells sized and configured to rest in respective laterally adjacent positions inside the at least one compartment;

providing a bench member sized and configured to support a person in a supine position;

providing wheels on at least one of the bench member and the base member;

configuring the bench member relative to the base member in a manner that defines an exercise bench, wherein the bench member is horizontally oriented and in direct contact with the floor surface;

removing the dumbbells from the at least one compartment;

performing exercise with the dumbbells while resting on the bench;

returning the dumbbells to the at least one compartment;

configuring the bench member relative to the base member in a manner that defines a weight cart, wherein the bench member extends vertically upward from the base member, and the wheels are in direct contact with the floor surface;

rolling the weight cart and dumbbells across the floor surface; and leaving the weight cart in a free standing position on the floor surface.

30. The method of claim 29, wherein the removing, performing, and returning steps are selectively performed after either said configuring step.

* * * * *